US006606887B1

(12) United States Patent
Zimmer et al.

(10) Patent No.: US 6,606,887 B1
(45) Date of Patent: Aug. 19, 2003

(54) ANTI-THEFT EQUIPMENT LOCKING COVER

(75) Inventors: David Zimmer, Tampa, FL (US); John LeBlanc, Bradenton, FL (US); Decha Narkmongkon, Seffner, FL (US); Raymond H. Williams, Lutz, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 09/683,262

(22) Filed: Dec. 5, 2001

(51) Int. Cl.[7] ..... B65D 55/14

(52) U.S. Cl. ..... 70/164; 70/14; 70/58; 70/232; 70/18

(58) Field of Search ..... 70/14, 18, 19, 70/58, 158–164, 229–232; 248/551–553

(56) References Cited

U.S. PATENT DOCUMENTS

| | | | | | |
|---|---|---|---|---|---|
| 2,479,300 | A | * | 8/1949 | Binz | 70/232 |
| 2,785,564 | A | * | 3/1957 | Rossi | 70/232 |
| 3,771,338 | A | | 11/1973 | Raskin | |
| 3,884,055 | A | * | 5/1975 | Vuillemot | 70/58 |
| 3,990,276 | A | | 11/1976 | Shontz | |
| 4,031,721 | A | * | 6/1977 | Anderson | 70/58 |
| 4,353,521 | A | * | 10/1982 | Webb | 70/58 X |
| 4,407,146 | A | * | 10/1983 | Nielsen, Jr. | 70/232 |
| 4,538,827 | A | * | 9/1985 | Plifka | 70/14 X |
| 4,577,884 | A | * | 3/1986 | Harris | 70/237 X |
| 5,076,077 | A | * | 12/1991 | Renne | 70/14 |
| 5,255,545 | A | * | 10/1993 | Wheeler | 70/232 |
| 5,351,511 | A | * | 10/1994 | Bernier | 70/232 |
| 5,359,868 | A | * | 11/1994 | Villani | 70/164 X |
| 5,375,916 | A | * | 12/1994 | Cook | 70/232 X |
| 5,873,271 | A | * | 2/1999 | Smith | 70/58 |
| 5,960,653 | A | * | 10/1999 | DeWalch et al. | 70/164 |
| 6,042,068 | A | | 3/2000 | Tcherny | |
| 6,070,441 | A | * | 6/2000 | Bernstrom | 70/58 |
| 6,082,601 | A | * | 7/2000 | Standish | 70/164 X |
| 6,202,453 | B1 | * | 3/2001 | Disher et al. | 70/14 |

OTHER PUBLICATIONS

Business Machine Security; http://bmsmfg.com; Feb. 4, 2002.

Aztec Security Products; http://www.aztec–coverpro.com; Feb. 4, 2002.

* cited by examiner

*Primary Examiner*—Suzanne Dino Barrett
(74) *Attorney, Agent, or Firm*—Anton J. Hopen; Smith & Hopen, P.A.

(57) ABSTRACT

An anti-theft equipment locking cover, including a first cover part adapted to overlie a first part of an item of equipment; the first cover part having a flange adapted to underlie a first edge of the item of equipment; a second cover part to overlie a second part of the item of equipment; the second cover part having a flange adapted to underlie a second edge of the item of equipment; the first and second cover parts being disposed in confronting relation to one another so that the item of equipment is fully covered by the confronting first and second cover parts; a tab secured to the first cover part; a slot formed in the second cover part that slideably receives the tab; a distal free end of the tab extending through the slot; an aperture formed in the distal free end of the tab; and a locking device adapted to extend through the aperture to prevent retraction of the tab from the slot.

7 Claims, 6 Drawing Sheets

ANTI-THEFT EQUIPMENT LOCKING COVER

BACKGROUND OF INVENTION

1. Field of Invention

This invention relates to anti-theft devices, and more particularly to a locking cover for equipment.

2. Background of the Invention

Video projection units (herein VPUs) are popular for education, entertainment and business development. Many VPUs are light and portable, particularly those employed by business travelers. However, there are occasions went VPUs are mounted in a substantially permanent location. Such mountings are common at universities and other educational institutions. As the VPUs project images onto a screen, they are often suspended by an elongated pole member disposed from the ceiling of a room. A mounting plate provides a secure interface between the support member and the VPU. Optionally, an adjustment bracket is provided to allow the VPU to be tilted up and down so that the projected image is centered on the screen. The adjustment bracket attached to a mounting plate. The mounting plate is screwed to the VPU itself.

Unfortunately, a theft risk exists in three areas: (1) removing the nuts that attach the adjustment bracket to the mounting plate, (2) removing the screws in the adjustment bracket itself, and (3) removing the screws which attach the mounting plate to the projector.

Accordingly, what is needed in the art is a locking cover that will not allow access to the above-mentioned areas of potential theft.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF INVENTION

The present invention provides an anti-theft equipment locking cover, which includes a first cover part adapted to overlie a first part of an item of equipment such as a VPU. The first cover part has a flange adapted to underlie a first edge of the item of equipment. A second cover part is provided and adapted to overlie a second part of the item of equipment, the second cover part having a flange adapted to underlie a second edge of the item of equipment. The first and second cover parts are disposed in confronting relation to one another so that the item of equipment is fully covered by the confronting first and second cover parts. A tab secured to the first cover part is slideably received by a slot formed in the second cover part, a distal free end of the tab extending through the slot. A aperture formed in the distal free end of the tab receives a locking means adapted to extend through the aperture to prevent retraction of the tab from the slot.

A pole member to which the item of equipment is secured may be provided. A first cut-out is formed in the first cover part, the first cut-out adapted to receive the pole member. A second cut-out is provided in the second cover part, the second cut-out adapted to receive the pole member in mirrored relation to the first cut-out, the pole being surrounded by the first and second cut-outs when the first and second cover parts are disposed in the confronting relation to one another.

A mounting plate adapted to engage the pole member is optionally provided and is adapted to secure to the item of equipment in overlying relation thereto, the mounting plate being disposed in sandwiched relation to the pole member and the item of equipment. An adjustment bracket adapted to engage the pole member may also be provided. A mounting plate is secured to the adjustment bracket which is disposed in overlying relation to the mounting plate. The mounting plate is adapted to be secured to the item of equipment in overlying relation thereto and the mounting plate is disposed in sandwiched relation to the adjustment bracket and the item of equipment. Optionally, either the mounting plate or the adjustment bracket is screw-theadingly engaged to the pole member.

While primary objective of the present invention is to protect VPUs, other equipment such as flat panel monitors, video cameras and the like may also comprise the item of equipment.

The pole member may be adapted to depend from a ceiling or be disposed in upstanding relation to a support surface such as a floor, desk or table.

It is therefore an object of the present invention to provide a theft protection device that a relatively simple, expensive and easy to install.

It is another object of the present invention to provide a theft protection device that may be retrofitted on existing equipment installations.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
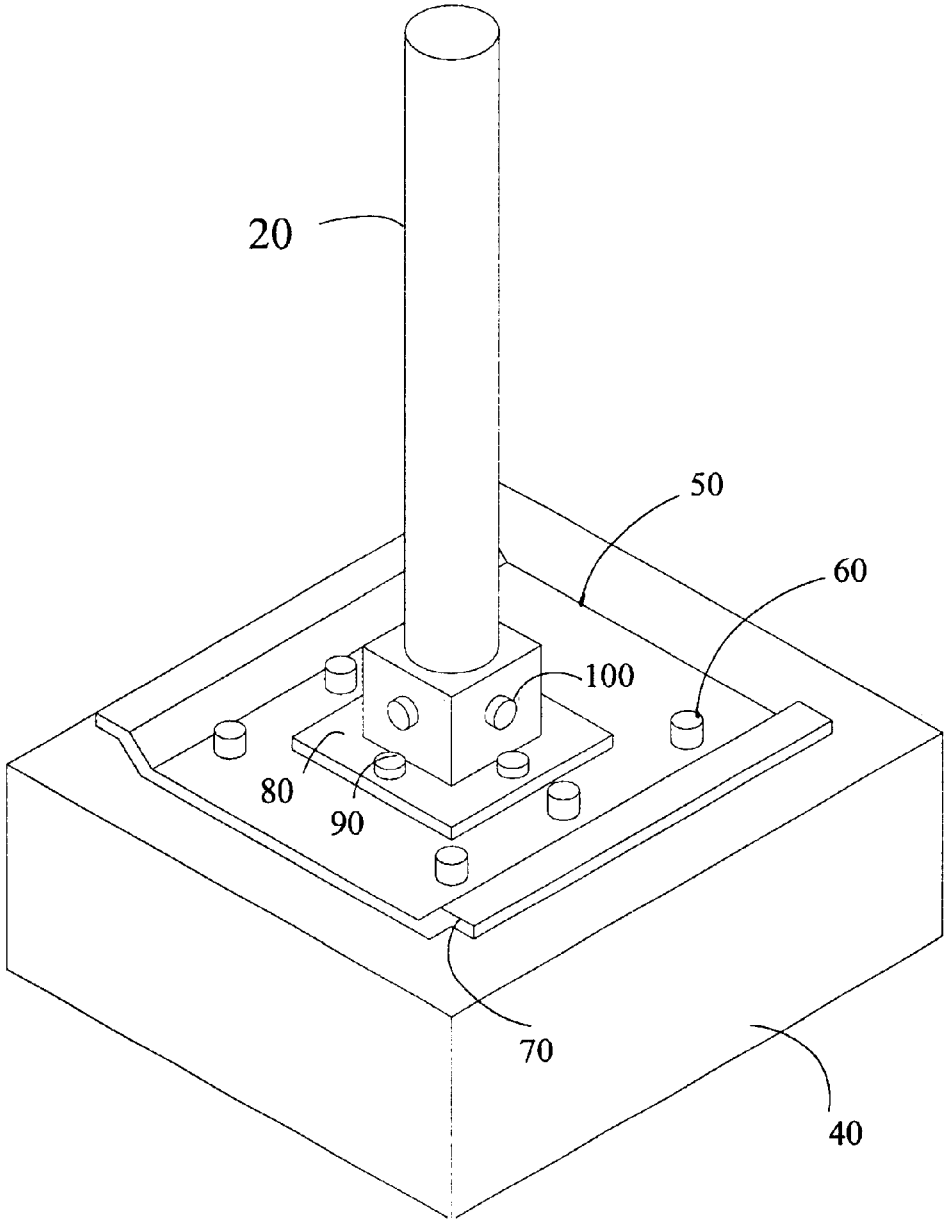
FIG. 1 is an isometric view of the mounting pole, adjustment bracket and mounting plate.

FIG. 1 shows a pole member 20, adjustment bracket 80 and mounting plate 50 which secures an item of equipment

40. In this illustration, the equipment 40 may be removed by (1) removing the adjustment bracket nuts 90 that attach the adjustment bracket 80 to the mounting plate 50; (2) removing the adjustment bracket screws 100 in the adjustment bracket itself; or (3) removing the mounting plate screws 60 which attach the mounting plate to the projector. It should be understood that references to screws, nuts and bolts are merely exemplary of a multitude of fasteners known to those of ordinary skill in the art to secure the equipment 40. It can clearly been seen there are numerous methods to remove the equipment with simple hardware. A first edge 70 of the mounting plate 50 is provided.

Figure 2:
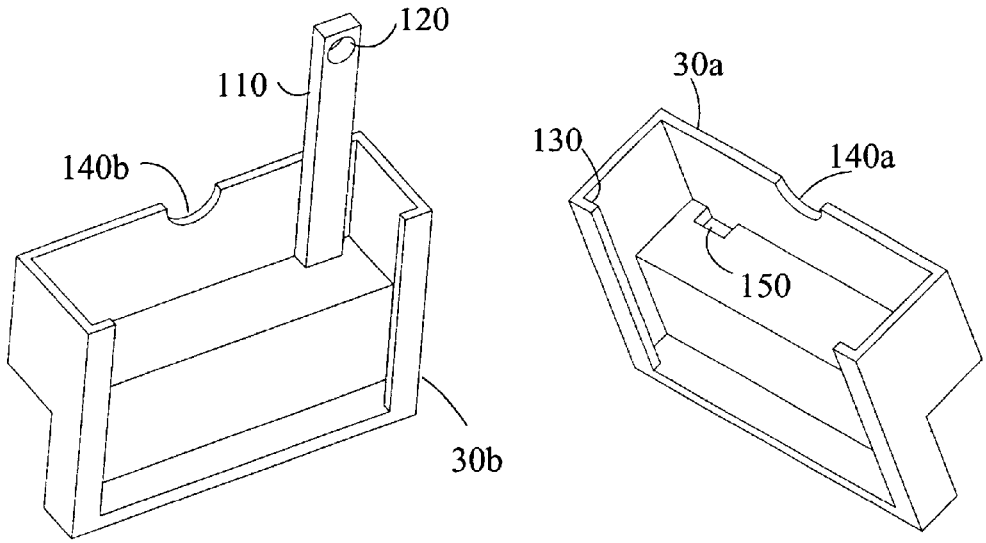
FIG. 2 is an exploded, isometric view of the invention.

FIG. 2 shows a first cover part 30*b* adapted to underlie the item of equipment 40. The first cover part 30*b* has a flange 130 adapted to underlie the first edge 70 of the mounting plate 50. A second cover part 30*a* also has the flange 130 as it is structurally a mirror of the first cover part 30*a*.

Figure 3:
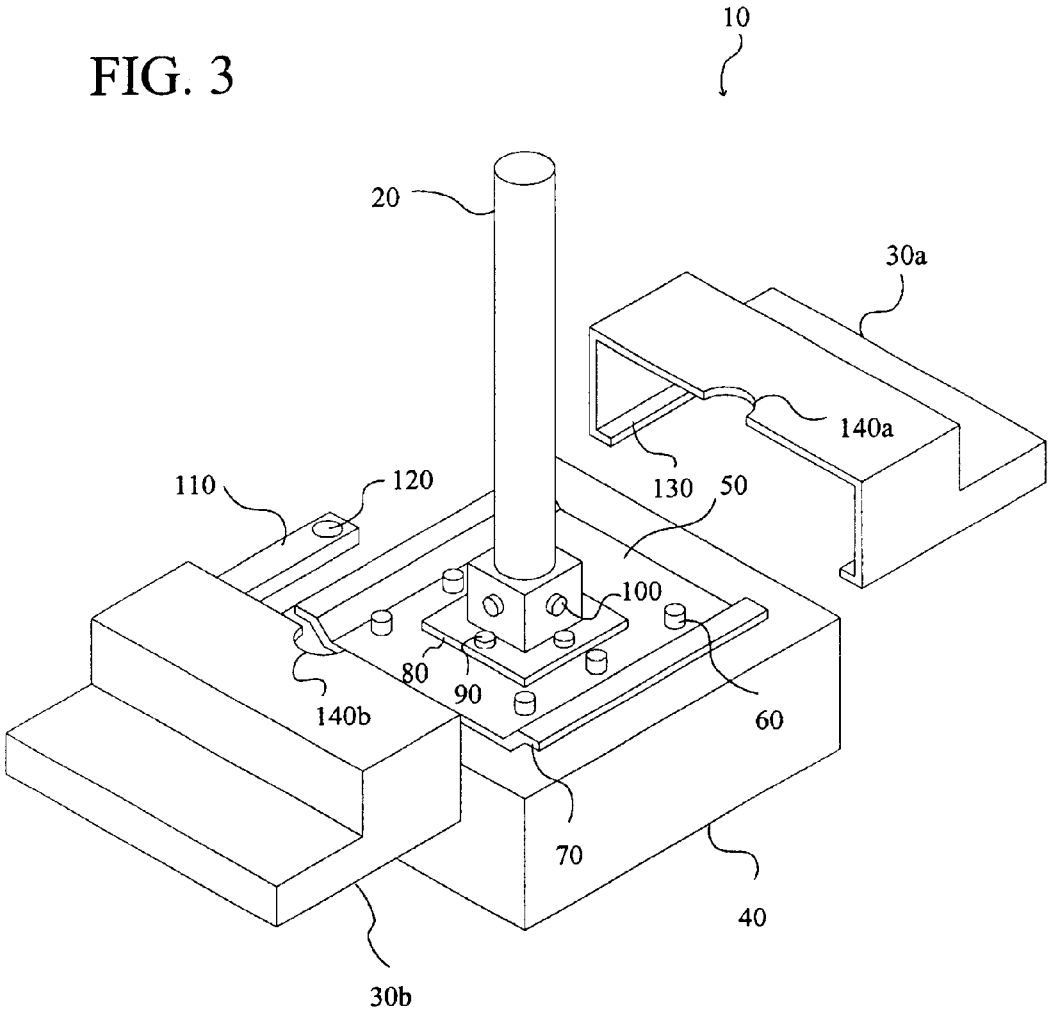
FIG. 3 is a partially exploded, isometric view of the invention in a state of pre-assembly.

In FIG. 3, the first cover part 30*b* and the second cover part 30*a* are disposed in confronting relation to one another so that the item of equipment 40 is fully covered by the confronting first and second cover parts when fully engaged. A slot 150 in the first cover part 30*b* slideably receives a tab 110 secured to the second cover part 30*a*, the distal free end of the tab 110 extending through the slot 150. An aperture 120 formed in the distal free end of the tab 110 is adapted to receive a locking means that extends through the aperture 120 to prevent retraction of the tab 110 from the slot 150. A first cut-out 140*b* in the first cover 30*b* is provided to receive the pole member 20 and a second cut-out 140*a* in the second cover 30*a* is provided in mirrored relation to the first-cut 140*b* to also receive the pole member 20 when fully engaged.

Figure 4:
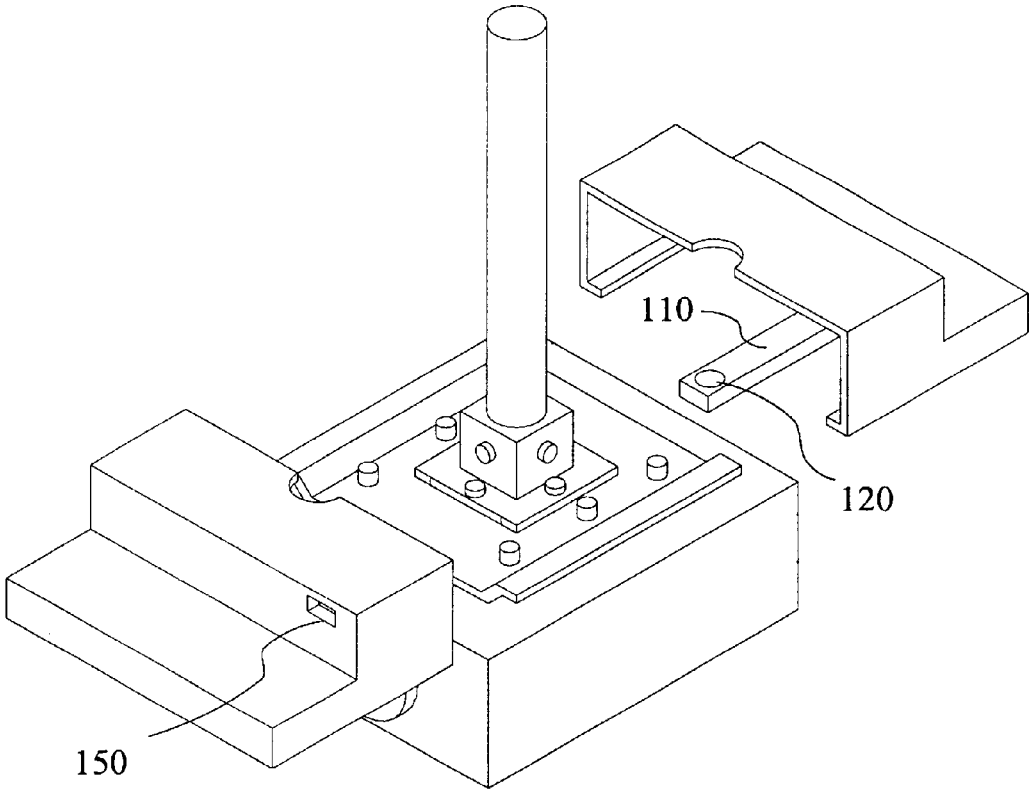
FIG. 4 is a partially exploded, isometric view of the invention in reverse orientation from FIG. 3 to show the slot element.
Figure 5:
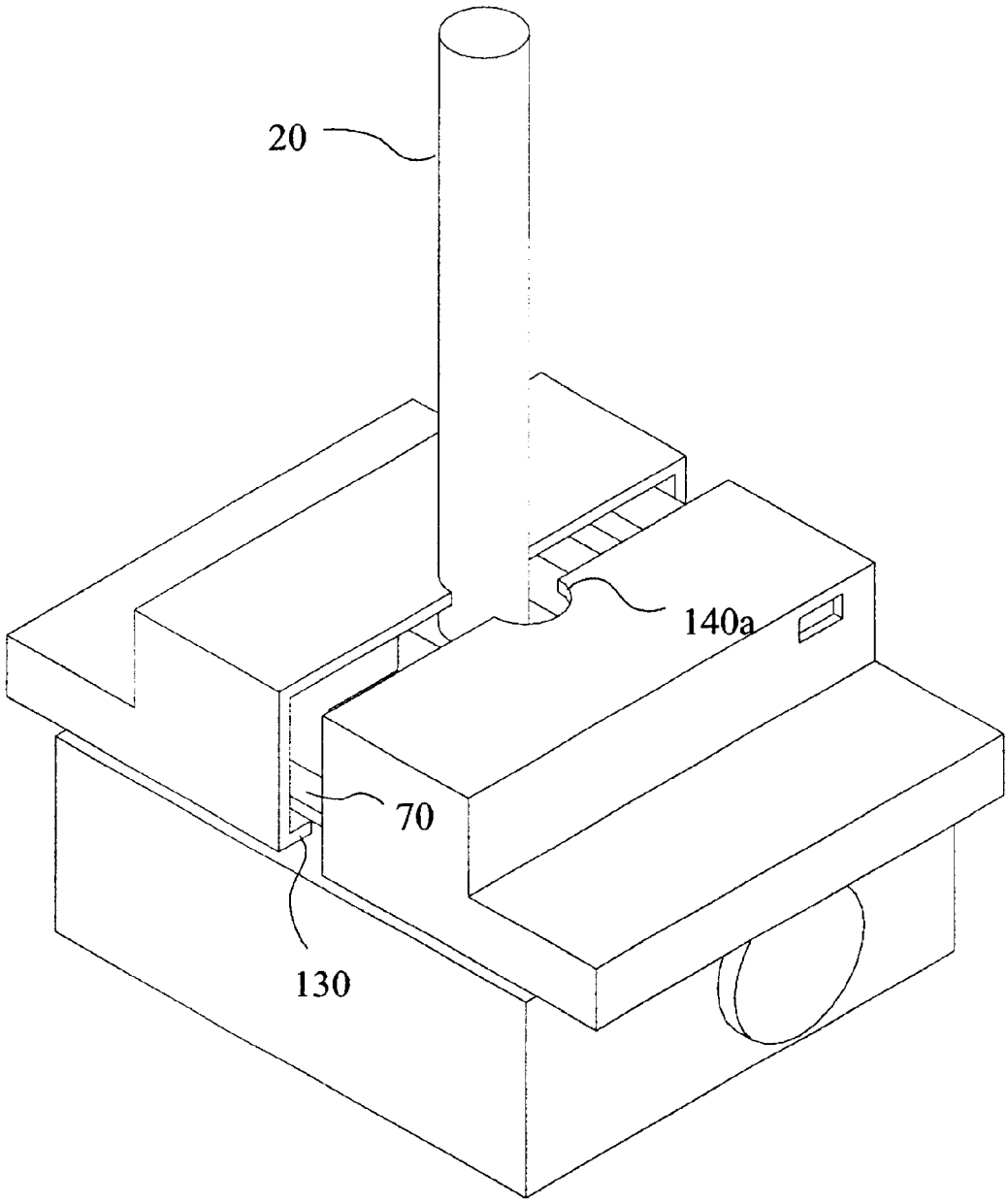
FIG. 5 is a partially exploded, isometric view of the invention in mid-assembly.

FIG. 4 illustrates the alignment and partial engagement of the tab 110 through the slot 150. In FIG. 5, still further engagement is illustrated with the second cutout 140*a* receiving the pole member 20. The flange 130 slideably receives the first edge 70 of the mounting plate 50.

Figure 6:
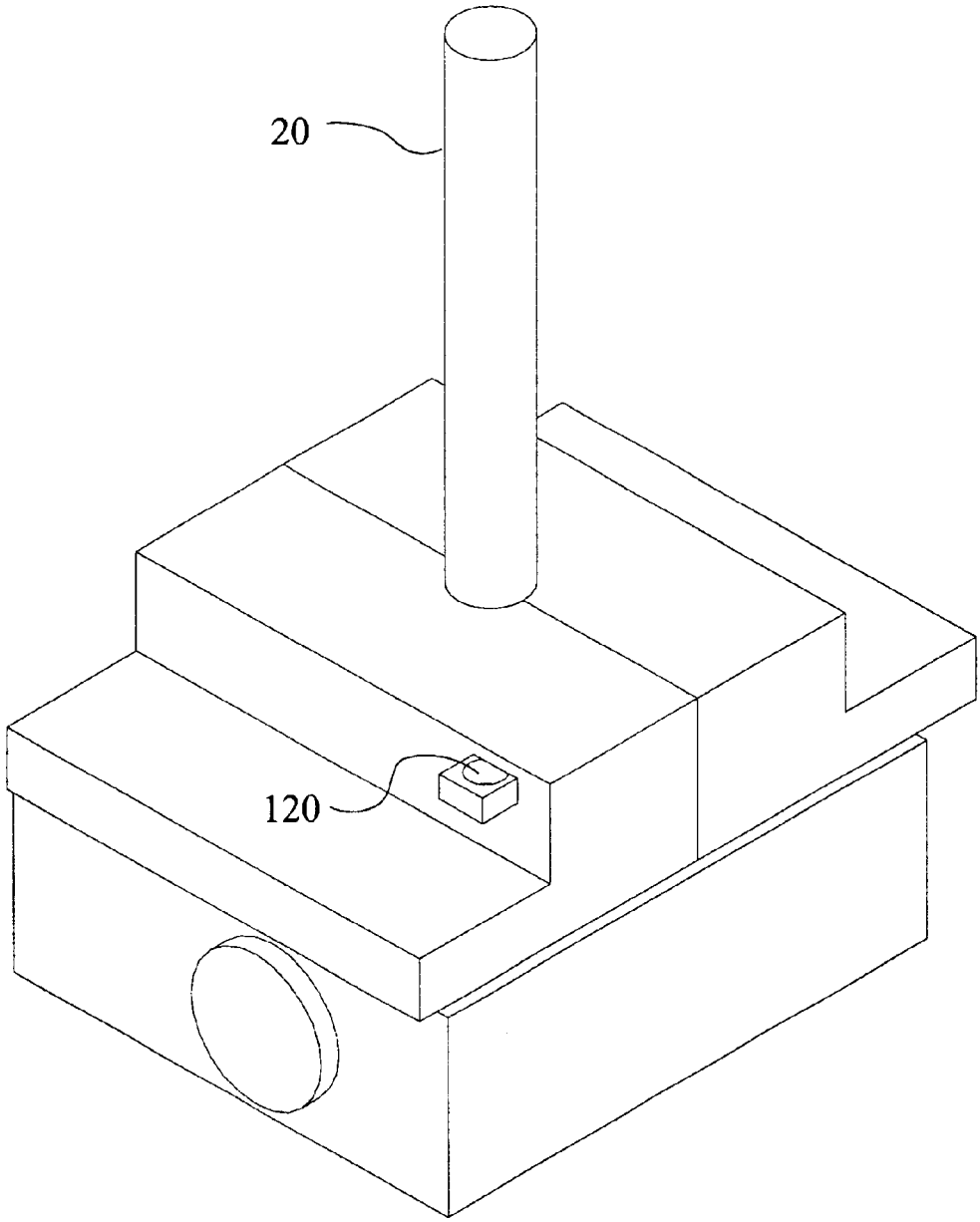
FIG. 6 is an isometric view of the invention fully assembled and engaged.

In FIG. 6, the apparatus is fully engaged with the aperture 120 exposed to receiving a locking means to prevent retraction of the tab 110 from the slot 150. The locking means must now be overcome, generally by cumbersome, destructive means, rather than by simple hardware as was previously known in the art.

It should be noted that the present invention should not be limited strictly to VPUs but should encompass any other type of equipment that requires protection.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be the to fall therebetween. Now that the invention has been described,

What is claimed is:

1. An anti-theft equipment locking apparatus, comprising:

a stationary pole member;

a mounting plate adapted to be secured to an item of equipment in overlying relation thereto, the mounting plate adapted to engage the pole member;

a first cover part adapted to overlie a first part of the mounting plate;

a first cover part having a flange adapted to underlie a first edge of the mounting plate;

a first cut-out formed in the first cover part, the first cutout adapted to receive the pole member;

a second cover part adapted to overlie a second part of the mounting plate;

the second cover part having a flange adapted to underlie a second edge of the mounting plate;

a second cut-out formed in the second cover part, the second cut-out adapted to receive the pole member;

the first and second cover parts being disposed in confronting relation to one another so that the mounting plate is fully covered by the confronting first and second cover parts;

the pole member being surrounded by the first and second cut-outs when the first and second cover parts are disposed in the confronting relation to one another;

a tab secured to the first cover part;

a slot formed in the second cover part that slideably receives the tab;

a distal free end of the tab extending through the slot;

an aperture formed in the distal free end of the tab; and a locking means adapted to extend through the aperture to prevent retraction of the tab from the slot.

2. The anti-theft equipment locking apparatus of claim 1, further comprising, an adjustment bracket disposed in overlying relation to the mounting plate and secured to the mounting plate, the adjustment bracket adapted to engage the pole member.

3. The anti-theft equipment locking apparatus of claim 1 wherein the mounting plate is screw-theadingly engaged to the pole member.

4. The anti-theft equipment locking apparatus of claim 2 wherein the adjustment bracket is screw-theadingly engaged to the pole member.

5. The anti-theft equipment locking apparatus of claim 1 wherein the item of equipment is a video projector.

6. The anti-theft equipment locking apparatus of claim 1 wherein the stationary pole member is adapted to depend from a ceiling.

7. The anti-theft equipment locking apparatus of claim 1 wherein the stationary pole member is adapted to be disposed in upstanding relation to a support surface.

* * * * *